US007959476B2

(12) United States Patent
Smith et al.

(10) Patent No.: US 7,959,476 B2
(45) Date of Patent: Jun. 14, 2011

(54) CLAMP FOR ELECTRICALLY COUPLING TO A BATTERY CONTACT

(75) Inventors: Clark E. Smith, Oswego, IL (US); Kevin I. Bertness, Batavia, IL (US)

(73) Assignee: Midtronics, Inc., Willowbrook, IL (US)

( * ) Notice: Subject to any disclaimer, the term of this patent is extended or adjusted under 35 U.S.C. 154(b) by 0 days.

(21) Appl. No.: 12/485,459

(22) Filed: Jun. 16, 2009

(65) Prior Publication Data

US 2009/0311919 A1 Dec. 17, 2009

Related U.S. Application Data

(60) Provisional application No. 61/061,848, filed on Jun. 16, 2008.

(51) Int. Cl.
*H01R 4/48* (2006.01)

(52) U.S. Cl. ..... 439/759; 439/829

(58) Field of Classification Search ..... 439/759, 439/829; D13/120; 324/437
See application file for complete search history.

(56) References Cited

U.S. PATENT DOCUMENTS

| | | | | |
|---|---|---|---|---|
| 3,267,452 | A * | 8/1966 | Wolf | 324/437 |
| 4,854,901 | A * | 8/1989 | Vernachio | 439/755 |
| 4,885,523 | A | 12/1989 | Koenck | 230/131 |
| 4,965,738 | A | 10/1990 | Bauer et al. | 320/136 |
| 5,030,916 | A | 7/1991 | Bokitch | 324/503 |
| 5,732,074 | A | 3/1998 | Spaur et al. | 370/313 |
| 6,008,652 | A | 12/1999 | Theofanopoulos et al. | 324/434 |
| 6,218,805 | B1 | 4/2001 | Melcher | 320/105 |
| 6,534,992 | B2 | 3/2003 | Meissner et al. | 324/426 |
| 6,623,314 | B1 * | 9/2003 | Cox et al. | 439/759 |
| 7,029,338 | B1 | 4/2006 | Orange et al. | 439/755 |
| 7,184,905 | B2 | 2/2007 | Stefan | 702/63 |
| 7,235,977 | B2 | 6/2007 | Koran et al. | 324/426 |
| 7,736,201 | B2 * | 6/2010 | Gathman et al. | 439/759 |
| 2004/0199343 | A1 | 10/2004 | Cardinal et al. | 702/63 |
| 2009/0247020 | A1 | 10/2009 | Gathman et al. | 439/759 |
| 2010/0115761 | A1 * | 5/2010 | Miller et al. | 29/623.1 |
| 2010/0221961 | A1 * | 9/2010 | Jensen et al. | 439/759 |

OTHER PUBLICATIONS

U.S. Appl. No. 61/040,039, filed Mar. 27, 2008.

* cited by examiner

*Primary Examiner* — Hae Moon Hyeon
(74) *Attorney, Agent, or Firm* — Alan G. Rego; Westman, Champlin & Kelly, P.A.

(57) ABSTRACT

A clamp that is capable of attaching to a battery post and also to a female receptacle terminal. The clamp includes a post-grasping portion that is capable of attaching to the battery post. The clamp also includes a male plug feature that is configured to fit into a female receptacle terminal.

15 Claims, 8 Drawing Sheets

SECTION A-A

SECTION A-A

CLAMP FOR ELECTRICALLY COUPLING TO A BATTERY CONTACT

CROSS-REFERENCE TO RELATED APPLICATION

The present application is based on and claims the benefit of U.S. provisional patent application Ser. No. 61/061,848, filed Jun. 16, 2008, the content of which is hereby incorporated by reference in its entirety.

BACKGROUND

The present embodiments generally relate to storage batteries. More specifically, the present embodiments relate to a clamps for electrically coupling to storage batteries.

Storage batteries, such as lead acid storage batteries of the type used in the automotive industry, have existed for many years. However, understanding the nature of such storage batteries, how such storage batteries operate and how to accurately test such batteries has been an ongoing endeavor and has proved quite difficult. Storage batteries consist of a plurality of individual storage cells electrically connected in series. Typically, each cell has a voltage potential of about 2.1 volts. By connecting the cells in series, the voltage of the individual cells are added in a cumulative manner. For example, in a typical automotive storage battery, six storage cells are used to provide a total voltage when the battery is fully charged up to 12.6 volts.

Several techniques have been used to test the condition of storage batteries. These techniques include a voltage test to determine if the battery voltage is below a certain threshold, and a load test that involves discharging a battery using a known load. A more recent technique involves measuring the conductance of the storage batteries. Various testers that employ this testing technique are described in U.S. Pat. No. 3,873,911, issued Mar. 25, 1975, to Champlin; U.S. Pat. No. 3,909,708, issued Sep. 30, 1975, to Champlin; U.S. Pat. No. 4,816,768, issued Mar. 28, 1989, to Champlin; U.S. Pat. No. 4,825,170, issued Apr. 25, 1989, to Champlin; U.S. Pat. No. 4,881,038, issued Nov. 14, 1989, to Champlin; U.S. Pat. No. 4,912,416, issued Mar. 27, 1990, to Champlin; U.S. Pat. No. 5,140,269, issued Aug. 18, 1992, to Champlin; U.S. Pat. No. 5,343,380, issued Aug. 30, 1994; U.S. Pat. No. 5,572,136, issued Nov. 5, 1996; U.S. Pat. No. 5,574,355, issued Nov. 12, 1996; U.S. Pat. No. 5,583,416, issued Dec. 10, 1996; U.S. Pat. No. 5,585,728, issued Dec. 17, 1996; U.S. Pat. No. 5,589,757, issued Dec. 31, 1996; U.S. Pat. No. 5,592,093, issued Jan. 7, 1997; U.S. Pat. No. 5,598,098, issued Jan. 28, 1997; U.S. Pat. No. 5,656,920, issued Aug. 12, 1997; U.S. Pat. No. 5,757,192, issued May 26, 1998; U.S. Pat. No. 5,821,756, issued Oct. 13, 1998; U.S. Pat. No. 5,831,435, issued Nov. 3, 1998; U.S. Pat. No. 5,871,858, issued Feb. 16, 1999; U.S. Pat. No. 5,914,605, issued Jun. 22, 1999; U.S. Pat. No. 5,945,829, issued Aug. 31, 1999; U.S. Pat. No. 6,002,238, issued Dec. 14, 1999; U.S. Pat. No. 6,037,751, issued Mar. 14, 2000; U.S. Pat. No. 6,037,777, issued Mar. 14, 2000; U.S. Pat. No. 6,051,976, issued Apr. 18, 2000; U.S. Pat. No. 6,081,098, issued Jun. 27, 2000; U.S. Pat. No. 6,091,245, issued Jul. 18, 2000; U.S. Pat. No. 6,104,167, issued Aug. 15, 2000; U.S. Pat. No. 6,137,269, issued Oct. 24, 2000; U.S. Pat. No. 6,163,156, issued Dec. 19, 2000; U.S. Pat. No. 6,172,483, issued Jan. 9, 2001; U.S. Pat. No. 6,172,505, issued Jan. 9, 2001; U.S. Pat. No. 6,222,369, issued Apr. 24, 2001; U.S. Pat. No. 6,225,808, issued May 1, 2001; U.S. Pat. No. 6,249,124, issued Jun. 19, 2001; U.S. Pat. No. 6,259,254, issued Jul. 10, 2001; U.S. Pat. No. 6,262,563, issued Jul. 17, 2001; U.S. Pat. No. 6,294,896, issued Sep. 25, 2001; U.S. Pat. No. 6,294,897, issued Sep. 25, 2001; U.S. Pat. No. 6,304,087, issued Oct. 16, 2001; U.S. Pat. No. 6,310,481, issued Oct. 30, 2001; U.S. Pat. No. 6,313,607, issued Nov. 6, 2001; U.S. Pat. No. 6,313,608, issued Nov. 6, 2001; U.S. Pat. No. 6,316,914, issued Nov. 13, 2001; U.S. Pat. No. 6,323,650, issued Nov. 27, 2001; U.S. Pat. No. 6,329,793, issued Dec. 11, 2001; U.S. Pat. No. 6,331,762, issued Dec. 18, 2001; U.S. Pat. No. 6,332,113, issued Dec. 18, 2001; U.S. Pat. No. 6,351,102, issued Feb. 26, 2002; U.S. Pat. No. 6,359,441, issued Mar. 19, 2002; U.S. Pat. No. 6,363,303, issued Mar. 26, 2002; U.S. Pat. No. 6,377,031, issued Apr. 23, 2002; U.S. Pat. No. 6,392,414, issued May 21, 2002; U.S. Pat. No. 6,417,669, issued Jul. 9, 2002; U.S. Pat. No. 6,424,158, issued Jul. 23, 2002; U.S. Pat. No. 6,441,585, issued Aug. 17, 2002; U.S. Pat. No. 6,437,957, issued Aug. 20, 2002; U.S. Pat. No. 6,445,158, issued Sep. 3, 2002; U.S. Pat. No. 6,456,045; U.S. Pat. No. 6,466,025, issued Oct. 15, 2002; U.S. Pat. No. 6,465,908, issued Oct. 15, 2002; U.S. Pat. No. 6,466,026, issued Oct. 15, 2002; U.S. Pat. No. 6,469,511, issued Nov. 22, 2002; U.S. Pat. No. 6,495,990, issued Dec. 17, 2002; U.S. Pat. No. 6,497,209, issued Dec. 24, 2002; U.S. Pat. No. 6,507,196, issued Jan. 14, 2003; U.S. Pat. No. 6,534,993; issued Mar. 18, 2003; U.S. Pat. No. 6,544,078, issued Apr. 8, 2003; U.S. Pat. No. 6,556,019, issued Apr. 29, 2003; U.S. Pat. No. 6,566,883, issued May 20, 2003; U.S. Pat. No. 6,586,941, issued Jul. 1, 2003; U.S. Pat. No. 6,597,150, issued Jul. 22, 2003; U.S. Pat. No. 6,621,272, issued Sep. 16, 2003; U.S. Pat. No. 6,623,314, issued Sep. 23, 2003; U.S. Pat. No. 6,633,165, issued Oct. 14, 2003; U.S. Pat. No. 6,635,974, issued Oct. 21, 2003; U.S. Pat. No. 6,707,303, issued Mar. 16, 2004; U.S. Pat. No. 6,737,831, issued May 18, 2004; U.S. Pat. No. 6,744,149, issued Jun. 1, 2004; U.S. Pat. No. 6,759,849, issued Jul. 6, 2004; U.S. Pat. No. 6,781,382, issued Aug. 24, 2004; U.S. Pat. No. 6,788,025, filed Sep. 7, 2004; U.S. Pat. No. 6,795,782, issued Sep. 21, 2004; U.S. Pat. No. 6,805,090, filed Oct. 19, 2004; U.S. Pat. No. 6,806,716, filed Oct. 19, 2004; U.S. Pat. No. 6,850,037, filed Feb. 1, 2005; U.S. Pat. No. 6,850,037, issued Feb. 1, 2005; U.S. Pat. No. 6,871,151, issued Mar. 22, 2005; U.S. Pat. No. 6,885,195, issued Apr. 26, 2005; U.S. Pat. No. 6,888,468, issued May 3, 2005; U.S. Pat. No. 6,891,378, issued May 10, 2005; U.S. Pat. No. 6,906,522, issued Jun. 14, 2005; U.S. Pat. No. 6,906,523, issued Jun. 14, 2005; U.S. Pat. No. 6,909,287, issued Jun. 21, 2005; U.S. Pat. No. 6,914,413, issued Jul. 5, 2005; U.S. Pat. No. 6,913,483, issued Jul. 5, 2005; U.S. Pat. No. 6,930,485, issued Aug. 16, 2005; U.S. Pat. No. 6,933,727, issued Aug. 23, 200; U.S. Pat. No. 6,941,234, filed Sep. 6, 2005; U.S. Pat. No. 6,967,484, issued Nov. 22, 2005; U.S. Pat. No. 6,998,847, issued Feb. 14, 2006; U.S. Pat. No. 7,003,410, issued Feb. 21, 2006; U.S. Pat. No. 7,003,411, issued Feb. 21, 2006; U.S. Pat. No. 7,012,433, issued Mar. 14, 2006; U.S. Pat. No. 7,015,674, issued Mar. 21, 2006; U.S. Pat. No. 7,034,541, issued Apr. 25, 2006; U.S. Pat. No. 7,039,533, issued May 2, 2006; U.S. Pat. No. 7,058,525, issued Jun. 6, 2006; U.S. Pat. No. 7,081,755, issued Jul. 25, 2006; U.S. Pat. No. 7,106,070, issued Sep. 12, 2006; U.S. Pat. No. 7,116,109, issued Oct. 3, 2006; U.S. Pat. No. 7,119,686, issued Oct. 10, 2006; and U.S. Pat. No. 7,126,341, issued Oct. 24, 2006; U.S. Pat. No. 7,154,276, issued Dec. 26, 2006; U.S. Pat. No. 7,198,510, issued Apr. 3, 2007; U.S. Pat. No. 7,363,175, issued Apr. 22, 2008; U.S. Pat. No. 7,208,914, issued Apr. 24, 2007; U.S. Pat. No. 7,246,015, issued Jul. 17, 2007; U.S. Pat. No. 7,295,936, issued Nov. 13, 2007; U.S. Pat. No. 7,319,304, issued Jan. 15, 2008; U.S. Pat. No. 7,363,175, issued Apr. 22, 2008; U.S. Pat. No. 7,398,176, issued Jul. 8, 2008; U.S. Pat. No. 7,408,358, issued Aug. 5, 2008; U.S. Pat. No. 7,425,833, issued Sep. 16, 2008; U.S. Pat. No. 7,446,536, issued Nov. 4, 2008; U.S. Ser. No. 09/780,146, filed Feb. 9, 2001, entitled STORAGE BATTERY WITH INTEGRAL BATTERY TESTER; U.S. Ser. No. 09/756,638, filed Jan. 8, 2001, entitled METHOD AND APPARATUS FOR DETERMINING BATTERY PROPERTIES FROM COMPLEX IMPEDANCE/ADMITTANCE; U.S. Ser. No. 09/862,783, filed May 21, 2001, entitled METHOD AND APPARATUS FOR TESTING CELLS AND BATTERIES EMBEDDED IN SERIES/PARALLEL SYSTEMS; U.S. Ser. No. 09/880,473, filed Jun. 13, 2001; entitled BATTERY TEST MODULE; U.S. Ser. No. 10/042,451, filed Jan. 8, 2002, entitled BATTERY CHARGE CONTROL DEVICE; U.S. Ser. No. 10/109,734, filed Mar. 28, 2002, entitled APPARATUS AND METHOD FOR COUNTERACTING SELF DISCHARGE IN A STORAGE BATTERY; U.S. Ser. No. 10/112,998, filed Mar. 29, 2002, entitled BATTERY TESTER WITH BATTERY REPLACEMENT OUTPUT; U.S. Ser. No. 10/263,473, filed Oct. 2, 2002, entitled ELECTRONIC BATTERY TESTER WITH RELATIVE TEST OUTPUT; U.S. Ser. No. 10/310,385, filed Dec. 5, 2002, entitled BATTERY TEST MODULE; U.S. Ser. No. 10/653,342, filed Sep. 2, 2003, entitled ELECTRONIC BATTERY TESTER CONFIGURED TO PREDICT A LOAD TEST RESULT; U.S. Ser. No. 10/441,271, filed May 19, 2003, entitled ELECTRONIC BATTERY TESTER; U.S. Ser. No. 09/653,963, filed Sep. 1, 2000, entitled SYSTEM AND METHOD FOR CONTROLLING POWER GENERATION AND STORAGE; U.S. Ser. No. 10/174,110, filed Jun. 18, 2002, entitled DAYTIME RUNNING LIGHT CONTROL USING AN INTELLIGENT POWER MANAGEMENT SYSTEM; U.S. Ser. No. 10/258,441, filed Apr. 9, 2003, entitled CURRENT MEASURING CIRCUIT SUITED FOR BATTERIES; U.S. Ser. No. 10/681,666, filed Oct. 8, 2003, entitled ELECTRONIC BATTERY TESTER WITH PROBE LIGHT; U.S. Ser. No. 10/783,682, filed Feb. 20, 2004, entitled REPLACEABLE CLAMP FOR ELECTRONIC BATTERY TESTER; U.S. Ser. No. 10/791,141, filed Mar. 2, 2004, entitled METHOD AND APPARATUS FOR AUDITING A BATTERY TEST; U.S. Ser. No. 10/867,385, filed Jun. 14, 2004, entitled ENERGY MANAGEMENT SYSTEM FOR AUTOMOTIVE VEHICLE; U.S. Ser. No. 10/896,834, filed Jul. 22, 2004, entitled ELECTRONIC BATTERY TESTER; U.S. Ser. No. 10/958,821, filed Oct. 5, 2004, entitled IN-VEHICLE BATTERY MONITOR; U.S. Ser. No. 10/958,812, filed Oct. 5, 2004, entitled SCAN TOOL FOR ELECTRONIC BATTERY TESTER; U.S. Ser. No. 11/008,456, filed Dec. 9, 2004, entitled APPARATUS AND METHOD FOR PREDICTING BATTERY CAPACITY AND FITNESS FOR SERVICE FROM A BATTERY DYNAMIC PARAMETER AND A RECOVERY VOLTAGE DIFFERENTIAL, U.S. Ser. No. 60/587,232, filed Dec. 14, 2004, entitled CELLTRON ULTRA, U.S. Ser. No. 11/018,785, filed Dec. 21, 2004, entitled WIRELESS BATTERY MONITOR; U.S. Ser. No. 60/653,537, filed Feb. 16, 2005, entitled CUSTOMER MANAGED WARRANTY CODE; U.S. Ser. No. 11/063,247, filed Feb. 22, 2005, entitled ELECTRONIC BATTERY TESTER OR CHARGER WITH DATABUS CONNECTION; U.S. Ser. No. 60/665,070, filed Mar. 24, 2005, entitled OHMMETER PROTECTION CIRCUIT; U.S. Ser. No. 11/141,234, filed May 31, 2005, entitled BATTERY TESTER CAPABLE OF IDENTIFYING FAULTY BATTERY POST ADAPTERS; U.S. Ser. No. 11/143,828, filed Jun. 2, 2005, entitled BATTERY TEST MODULE; U.S. Ser. No. 11/146,608, filed Jun. 7, 2005, entitled SCAN TOOL FOR ELECTRONIC BATTERY TESTER; U.S. Ser. No. 60,694,199, filed Jun. 27, 2005, entitled GEL BATTERY CONDUCTANCE COMPENSATION; U.S. Ser. No. 11/178,550, filed Jul. 11, 2005, entitled WIRELESS BATTERY TESTER/CHARGER; U.S. Ser. No. 60/705,389, filed Aug. 4, 2005, entitled PORTABLE TOOL THEFT PREVENTION SYSTEM, U.S. Ser. No. 11/207,419, filed Aug. 19, 2005, entitled SYSTEM FOR AUTOMATICALLY GATHERING BATTERY INFORMATION FOR USE DURING BATTERY TESTER/CHARGING, U.S. Ser. No. 60/712,322, filed Aug. 29, 2005, entitled AUTOMOTIVE VEHICLE ELECTRICAL SYSTEM DIAGNOSTIC DEVICE, U.S. Ser. No. 60/713,168, filed Aug. 31, 2005, entitled LOAD TESTER SIMULATION WITH DISCHARGE COMPENSATION, U.S. Ser. No. 60/731,881, filed Oct. 31, 2005, entitled PLUG-IN FEATURES FOR BATTERY TESTERS; U.S. Ser. No. 60/731,887, filed Oct. 31, 2005, entitled AUTOMOTIVE VEHICLE ELECTRICAL SYSTEM DIAGNOSTIC DEVICE; U.S. Ser. No. 11/304,004, filed Dec. 14, 2005, entitled BATTERY TESTER THAT CALCULATES ITS OWN REFERENCE VALUES; U.S. Ser. No. 60/751,853, filed Dec. 20, 2005, entitled BATTERY MONITORING SYSTEM; U.S. Ser. No. 11/304,004, filed Dec. 14, 2005, entitled BATTERY TESTER WITH CALCULATES ITS OWN REFERENCE VALUES; U.S. Ser. No. 60/751,853, filed Dec. 20, 2005, entitled BATTERY MONITORING SYSTEM; U.S. Ser. No. 11/356,299, filed Feb. 16, 2006, entitled CENTRALLY MONITORED SALES OF STORAGE BATTERIES; U.S. Ser. No. 11/356,443, filed Feb. 16, 2006, entitled ELECTRONIC BATTERY TESTER WITH NETWORK COMMUNICATION; U.S. Ser. No. 11/498,703, filed Aug. 3, 2006, entitled THEFT PREVENTION DEVICE FOR AUTOMOTIVE VEHICLE SERVICE CENTERS; U.S. Ser. No. 11/507,157, filed Aug. 21, 2006, entitled APPARATUS AND METHOD FOR SIMULATING A BATTERY TESTER WITH A FIXED RESISTANCE LOAD; U.S. Ser. No. 11/511,872, filed Aug. 29, 2006, entitled AUTOMOTIVE VEHICLE ELECTRICAL SYSTEM DIAGNOSTIC DEVICE; U.S. Ser. No. 11/519,481, filed Sep. 12, 2006, entitled BROAD-BAND LOW-CONDUCTANCE CABLES FOR MAKING KELVIN CONNECTIONS TO ELECTROCHEMICAL CELLS AND BATTERIES; U.S. Ser. No. 60/847,064, filed Sep. 25, 2006, entitled STATIONARY BATTERY MONITORING ALGORITHMS; U.S. Ser. No. 11/638,771, filed Dec. 14, 2006, entitled BATTERY MONITORING SYSTEM; U.S. Ser. No. 11/641,594, filed Dec. 19, 2006, entitled METHOD AND APPARATUS FOR MEASURING A PARAMETER OF A VEHICLE ELECTRONIC SYSTEM; U.S. Ser. No. 11/711,356, filed Feb. 27, 2007, entitled BATTERY TESTER WITH PROMOTION FEATURE; U.S. Ser. No. 11/811,528, filed Jun. 11, 2007, entitled ALTERNATOR TESTER; U.S. Ser. No. 60/950,182, filed Jul. 17, 2007, entitled BATTERY TESTER FOR HYBRID VEHICLE; U.S. Ser. No. 60/973,879, filed Sep. 20, 2007, entitled ELECTRONIC BATTERY TESTER FOR TESTING STATIONARY BATTERIES; U.S. Ser. No. 11/931,907, filed Oct. 31, 2007, entitled BATTERY MAINTENANCE WITH PROBE LIGHT; U.S. Ser. No. 60/992,798, filed Dec. 6, 2007, entitled STORAGE BATTERY AND BATTERY TESTER; U.S. Ser. No. 12/099,826, filed Apr. 9, 2008, entitled BATTERY RUN DOWN INDICATOR; U.S. Ser. No. 61/061,848, filed Jun. 16, 2008, entitled KELVIN CLAMP FOR ELECTRONICALLY COUPLING TO A BATTERY CONTACT; U.S. Ser. No. 12/168,264, filed Jul. 7, 2008, entitled BATTERY TESTERS WITH SECONDARY FUNCTIONALITY; U.S. Ser. No. 12/174,894, filed Jul. 17, 2008, entitled BATTERY TESTER FOR ELECTRIC VEHICLE; U.S. Ser. No. 12/204,141, filed Sep. 4, 2008, entitled ELECTRONIC BATTERY TESTER OR CHARGER WITH DATABUS CONNECTION; which are incorporated herein in their entirety.

The battery testing technique that involves measuring the conductance of the storage batteries typically involves the use of Kelvin connections for testing equipment. A Kelvin connection is a four point connection technique that allows current to be injected into a battery through a first pair of connectors attached to the battery contacts, while a second pair of connectors is attached to the battery contacts in order to measure the voltage across the posts. Various types of clamps have been designed to couple to the battery terminals and to continue the circuit that includes the Kelvin connection. However, these prior art clamps are generally suitable only for attachment to battery posts that extend outwardly from a battery housing. In general, clamps that are designed to electrically couple a single electrical connector or multiple electrical connectors (for example, Kelvin connectors) to a battery terminal are typically suited only for attachment to outwardly-extending battery posts.

SUMMARY

A clamp that is capable of attaching to a battery post and also to a female receptacle terminal is provided. The clamp includes a post-grasping portion that is capable of attaching to the battery post. The clamp also includes a male plug feature that is configured to fit into a female receptacle terminal.

BRIEF DESCRIPTION OF THE DRAWINGS

FIGS. 3-1 and 3-2 show a Kelvin clamp in accordance with one of the present embodiments.

FIG. 3-3 shows a sectional view (section A-A in FIG. 3-1) of the Kelvin clamp of FIG. 3-1.

DETAILED DESCRIPTION OF THE PREFERRED EMBODIMENTS

Figure 1:
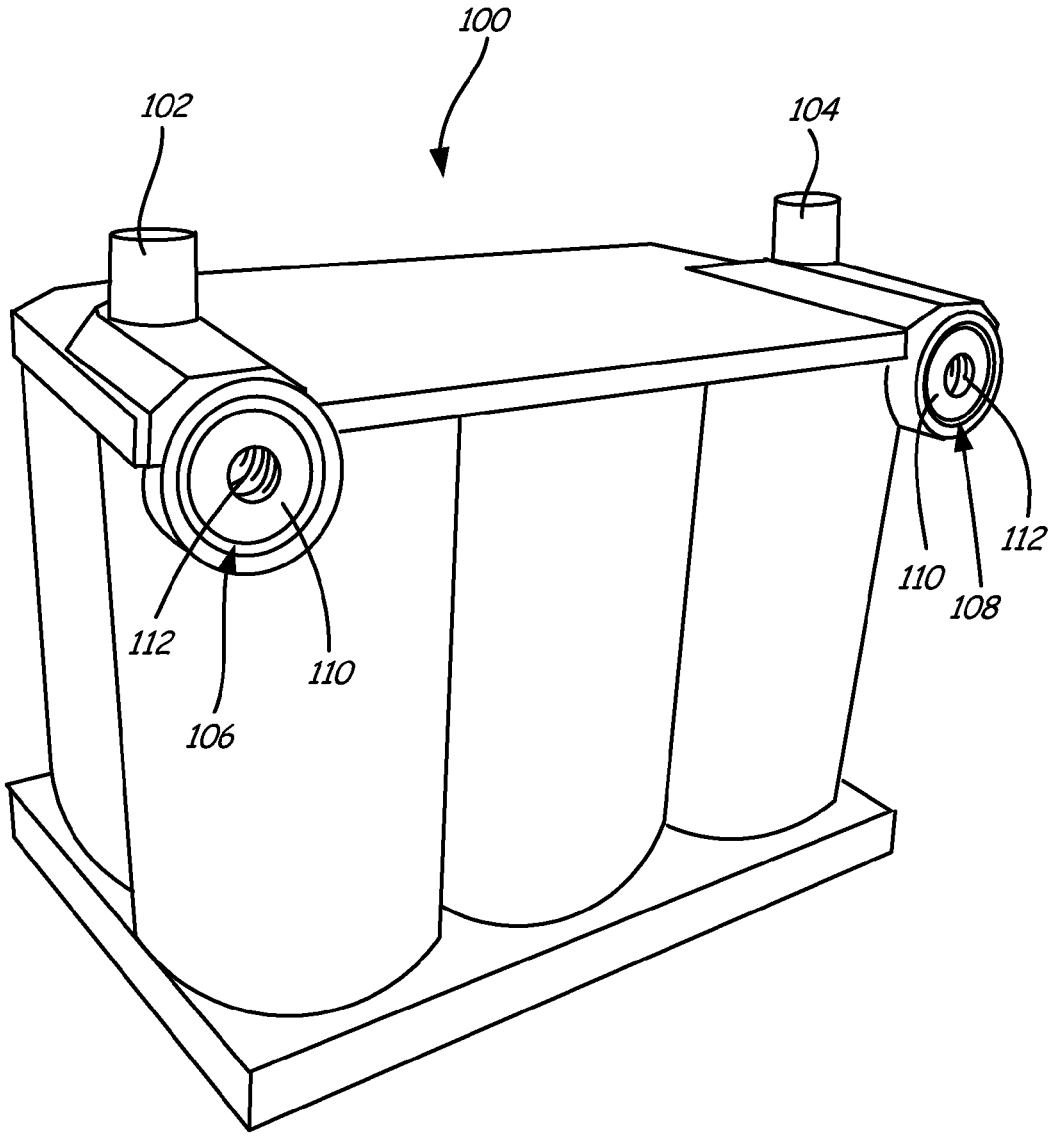
FIG. 1 shows a battery having different types of battery contacts.

In the discussion below, the term "battery contact" is used to define a portion of the battery onto which clamps of the present embodiments can be applied. FIG. 1 shows a battery 100 having different types of battery contacts to which a clamp in accordance with the present embodiments can couple. Battery contacts 102 and 104 are battery posts, and contacts 106 and 108 are side screw terminals. In general, battery posts can be positioned anywhere on the battery housing and extend outwardly from the battery housing. Side screw terminals are a specific example of female receptacle terminals. In general, a female receptacle terminal can be present anywhere on the battery housing and includes a receptacle for a male plug feature configured to fit into the receptacle. In battery 100 of FIG. 1, each of side screw terminals 106 and 108 includes a lead ring 110 with an embedded threaded feature 112 (for example, a stainless steel Helicoil® thread), which is in contact with the lead ring 110.

Figure 2:
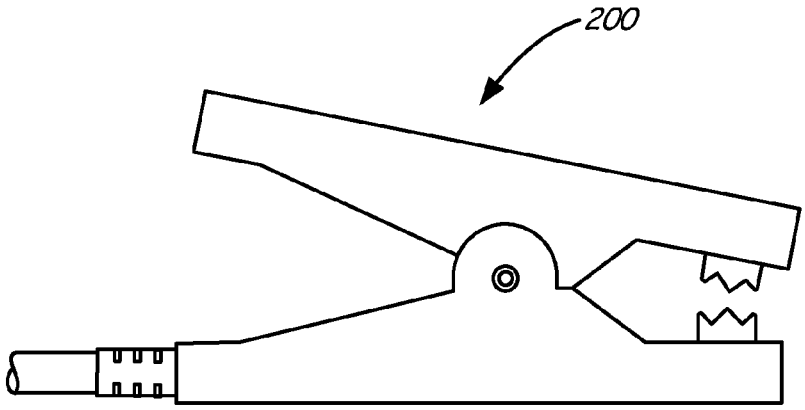
FIG. 2 illustrates a diagrammatic view of a clamp.

It is relatively easy to properly connect to battery posts 102 and 104 using any suitable clamp such as the example Kelvin clamp 200 shown in FIG. 2 that directly attaches to a post. However, proper electrical connection to side screw terminals 106 and 108 with a clamp such as Kelvin clamp 200 can usually be carried out only by screwing in lead terminal adapters (not shown) that effectively change side screw terminals such as 106 and 108 to battery posts. Thus, a clamp such as Kelvin clamp 200 cannot be directly attached to side screw terminals or, in general, to female receptacle terminals.

Figures 1, 3:
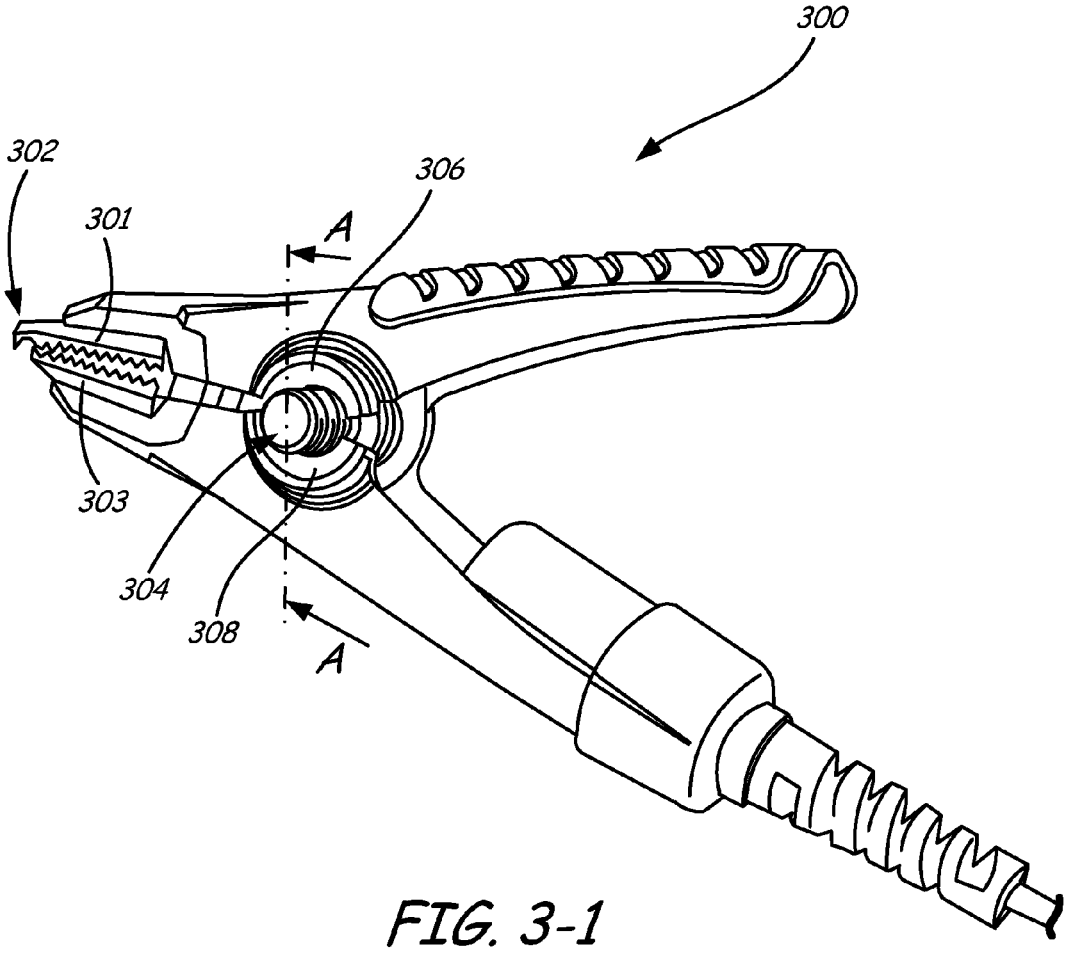
Figures 2, 3:
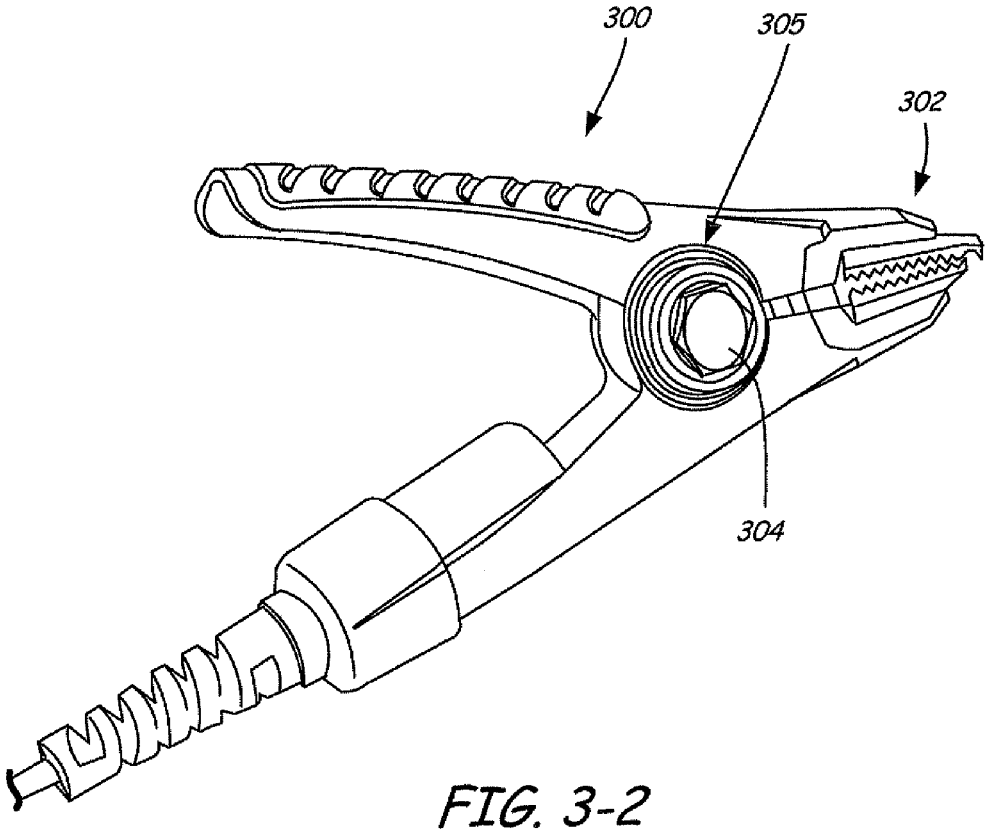
Figure 3:
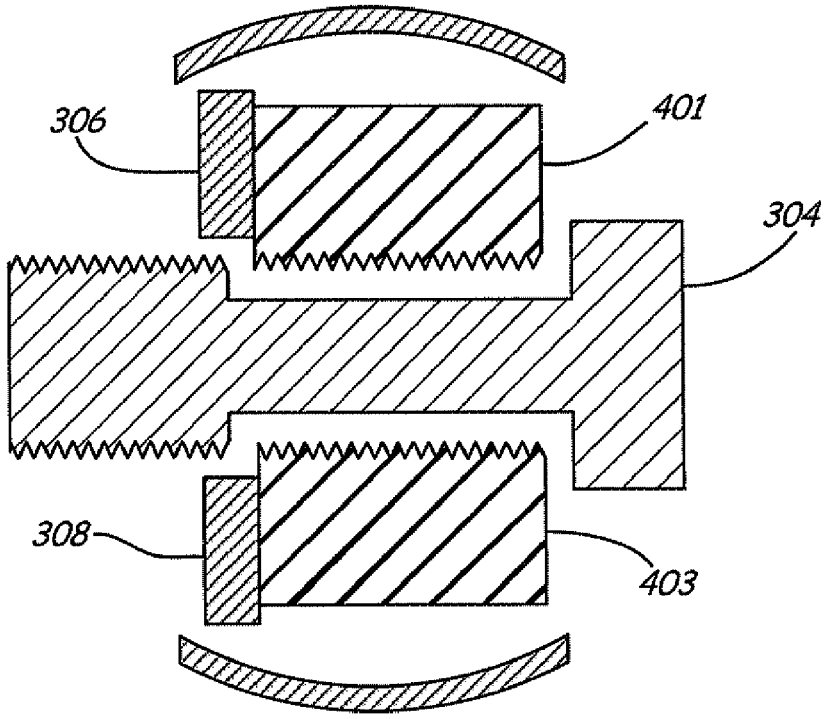

FIGS. 3-1 and 3-2 show a clamp 300 in accordance with one of the present embodiments. In the specific examples shown in FIGS. 3-1 and 3-2, clamp 300 is a Kelvin clamp. However, the teachings of the present disclosure apply to clamps that have single connections (only one conductor per clamp), Kelvin clamps that have two conductors per clamp, or any other suitable clamps. In general, Kelvin clamp 300 is capable of attaching to both battery posts and female receptacle terminals. Specifically, as can be seen in FIGS. 3-1 and 3-2, Kelvin clamp 300 includes a post-grasping portion 302, comprising a first post grasping member (for example, jaw 301) and a second post grasping member (for example, jaw 303), a clamp pivot 305 and a male plug feature 304 that is configured to fit into a female receptacle terminal. In a specific embodiment, male plug feature 304 is a bolt (for example, a thumbscrew or a knurled bolt). Thus, Kelvin clamp 300 can be used normally to attach to posts such as 102 and 104 (shown in FIG. 1), or twisted on the side and threaded into side screw terminals such as 106 and 108 (shown in FIG. 1). There is a contact embedded into each half of Kelvin clamp 300 for providing a Kelvin connection.

In the embodiment shown in FIGS. 3-1 and 3-2, male plug feature 304 is electrically isolated in Kelvin clamp 300 and forms an axle for the clamp 300. The Kelvin connections are features 306 and 308 shown in FIG. 3-1. In the specific example of FIG. 3-1, features 306 and 308 are electrically conductive arcs (for example, copper arcs). However, in some embodiments, features 306 and 308 may have any other suitable shape. In general, features 306 and 308 are any suitably shaped electrically conductive pieces. As noted above, in battery 100 (FIG. 1), each of side screw terminals 106 and 108 includes a lead ring 110 with an embedded threaded feature 112 (for example, a stainless steel Helicoil® thread), which is in contact with the lead ring 110. When bolt 304 is threaded into female receptacle terminal 106, 108, its potential becomes the potential of lead ring 110, but does not conduct this potential to any circuit. When bolt 304 is properly introduced into female receptacle terminal 106, 108, copper arcs 306 and 308 contact lead ring 110 of female receptacle terminal 106, 108.

FIG. 3-3 shows a sectional view (section A-A in FIG. 3-1) of Kelvin clamp 300. As can be seen in FIG. 3-3, arcs (in general, a first electrically conductive piece and a second electrically piece) 306 and 308 are electrically isolated from each other and from bolt (in general, male plug feature) 304. In addition to helping provide necessary electrical isolation, insulators 401 and 403 also help keep bolt 304 in place in Kelvin clamp 300. Bolt 304 may be made of any suitable material.

Figure 4:
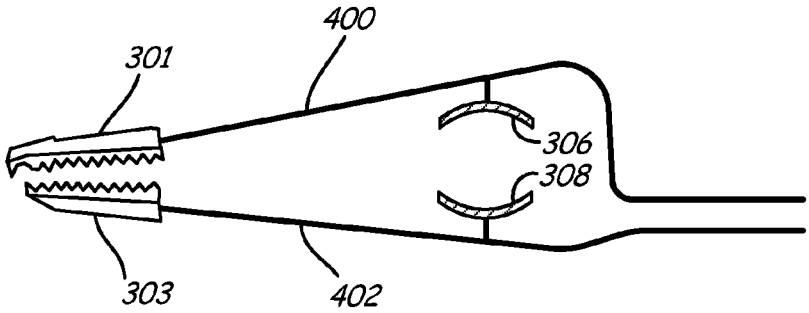
FIG. 4 is a diagrammatic illustration of electrical connections within the Kelvin clamp of FIGS. 3-1 and 3-2.

FIG. 4 is a diagrammatic illustration of electrical connections within Kelvin clamp 300. As can be seen in FIG. 4, a first Kelvin conductor 400 is electrically coupled to jaw (in general, first post grasping member) 301 and to arc (in general, first electrically conductive piece) 306. A second Kelvin conductor 402 is electrically coupled to jaw (in general, second post grasping member) 303 and to arc (in general, second electrically conductive piece) 308. Kelvin conductors 400 and 402 are electrically isolated from each other. As noted above, the disclosure is not limited to Kelvin clamps and therefore other configurations of internal clamp connections may be used.

The present embodiments, described above, are particularly useful with equipment for testing and charging storage batteries. Battery testers and chargers employing Kelvin clamps in accordance with the present embodiments are described below in connection with FIGS. 5 and 6.

Figure 5:
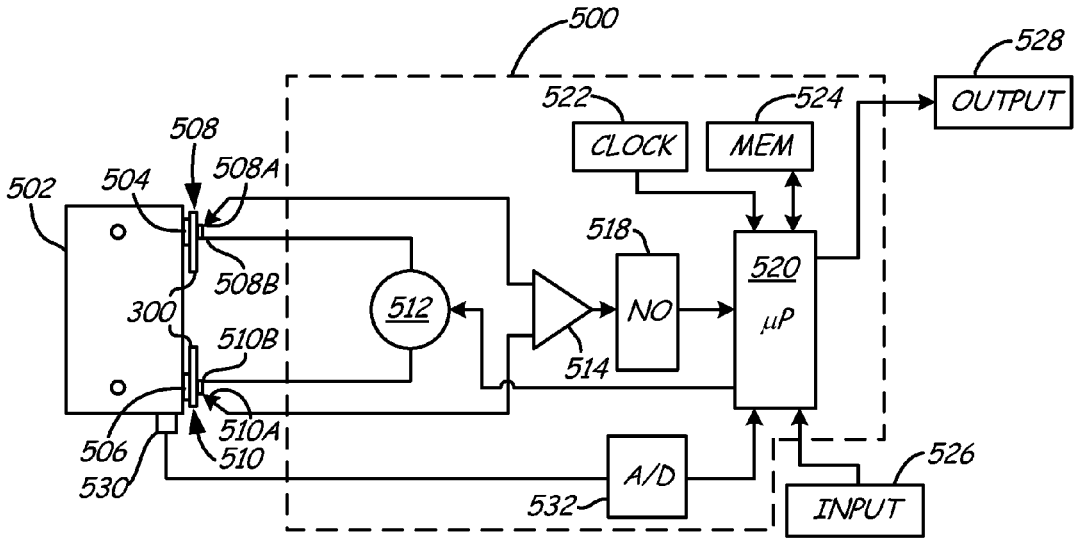
FIG. 5 is a simplified block diagram of a battery tester with which the Kelvin clamp in accordance with the present embodiments is useful.

FIG. 5 is a simplified block diagram of electronic battery tester circuitry 500 with which the present embodiments are useful. A four point (or Kelvin connection) technique is used to couple system 500 to battery 502. Kelvin connections 508 and 510 are used to couple to battery contacts 504 and 506, respectively, of battery 502. Kelvin connection 508 includes two individual connections 508A and 508B. Similarly, Kelvin connection 510 includes two individual connections, 510A and 510B. Kelvin clamps 300 (FIGS. 3-1, 3-2 and 3-3) attach to battery contacts 504 and 506 and couple them to electrical connections 508, 510.

Circuitry 500 includes a current source 512 and a differential amplifier 514. Current source 512 is coupled to connections 508B and 510B of Kelvin connections 508 and 510, respectively. Differential amplifier 514 is coupled to connection 508A and connection 510A of Kelvin connections 508 and 510, respectively. An output from differential amplifier 514 is provided to analog to digital converter 518 which itself provides a digitized output to microprocessor 520. Microprocessor 520 is connected to a system clock 522, a memory 524, and analog to digital converter 518. Microprocessor 520 is also capable of receiving an input from an input device 526 and providing an output of output device 528. The input can be, for example, a rating for the battery 502. Input device 526 can comprise any or multiple types of input devices. The result of a battery test, either qualitative or quantitative, can be an output device 528. Device 528 can be a display or other output. The embodiments can operate with any technique for determining a voltage across battery 502 and a current through battery 502 and is not limited to the specific techniques set forth herein. The forcing function source or current source 512 can provide any signal having a time varying component, including a stepped pulse or a periodic signal, having any shape, applied to battery 502. The current source can be an active source in which the current source signal is injected into battery 502, or can be a passive source, such as a load, which is switched on under the control of microprocessor 520.

In operation, microprocessor 520 can receive an input through input 526, such as a rating for battery 502. Microprocessor 520 determines a dynamic parameter, such as dynamic conductance, of battery 502 as a function of sensed voltage and current. The change in these sensed values is used to determine the dynamic parameter. For example, the dynamic conductance ($\Delta G$) is determined as:

$$\Delta G = \Delta I / \Delta V \qquad \text{EQ. 1}$$

where $\Delta I$ is the change in current flowing through battery 502 due to current source 512 and $\Delta V$ is the change in battery voltage due to applied current $\Delta I$. A temperature sensor 530 can be thermally coupled to battery 502 and used to compensate battery measurements. Temperature readings can be stored in memory 524 for later retrieval.

Figure 6:
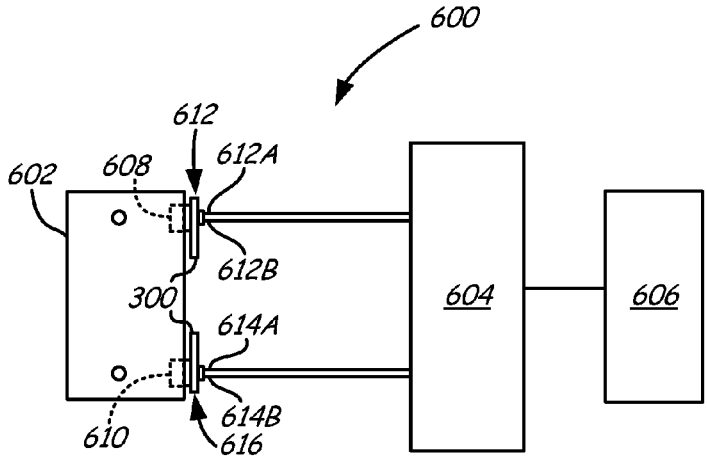
FIG. 6 is a simplified block diagram of a battery charger with which the Kelvin clamp in accordance with the present embodiments is useful.

FIG. 6 is a simplified block diagram of a battery charging system 600 using one of the present embodiments. System 600 is shown coupled to battery 602. System 600 includes battery charging and testing circuitry 604 and microprocessor 606. System 600 couples to battery contacts 608 and 610 through Kelvin electrical connections 612 and 614 respectively. Electrical connection 612 includes a first connection 612A and second connection 612B and connection 614 includes a first connection 614A and a second connection 614B. Kelvin clamps 300 (FIGS. 3-1, 3-2 and 3-3) provide coupling between battery contacts 608 and 610 and electrical connections 612 and 614. Battery charger 600 operates in a manner similar to the battery charger set forth in U.S. Pat. No. 6,104,167, issued Aug. 15, 2000, and entitled "METHOD AND APPARATUS FOR CHARGING A BATTERY", which is incorporated herein by reference.

Figure 7:
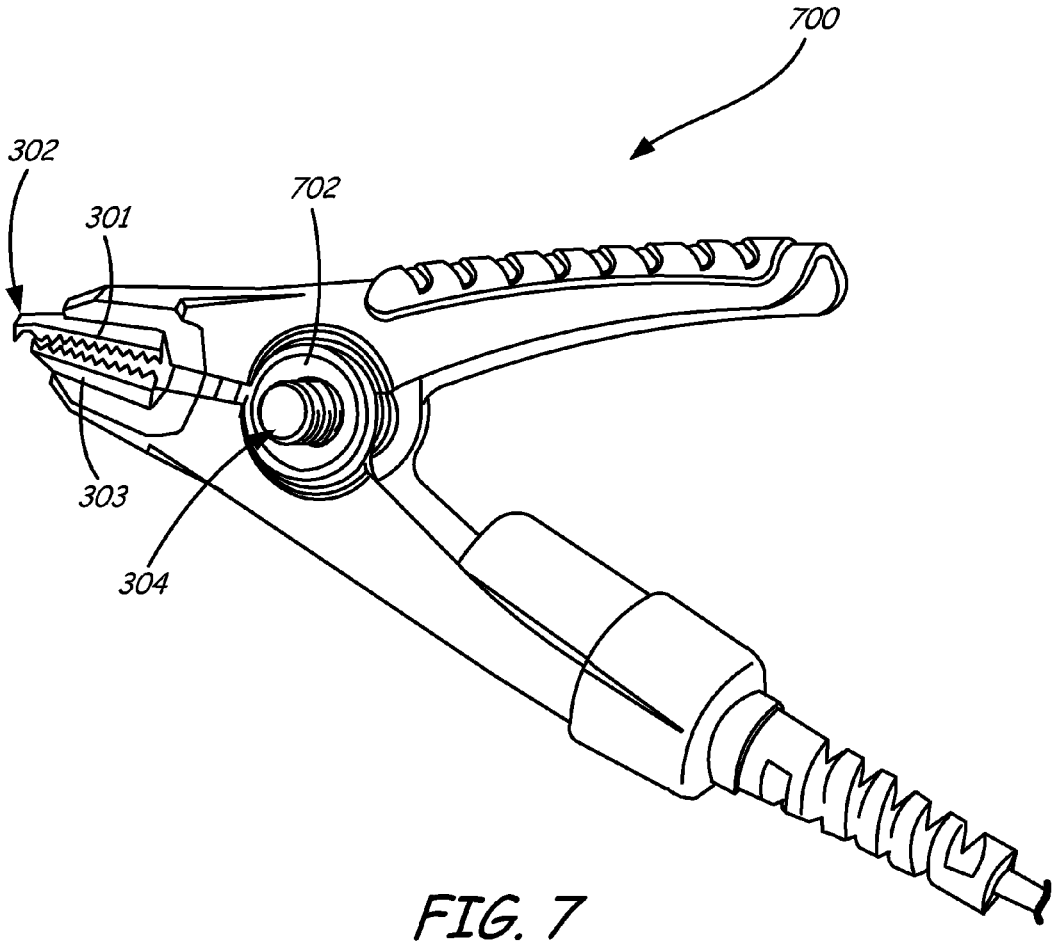
FIG. 7 shows a clamp in accordance with one of the present embodiments.

FIG. 7 shows a clamp 700 in accordance with one of the present embodiments. The same reference numerals utilized in FIGS. 3-1, 3-2 and 3-3 are also used in FIG. 7 for all components of clamp 700 that are substantially similar to components of clamp 300 (FIGS. 3-1, 3-2 and 3-3). As can be seen in FIG. 7, instead of utilizing two separate electrically conductive pieces 306 and 308, a single electrically conductive piece 702 of any suitable shape is utilized. Such a configuration is more useful form a single connection with only one conductor per clamp.

Although the present disclosure is directed to preferred embodiments, workers skilled in the art will recognize that changes may be made in form and detail without departing from the spirit and scope of the disclosure. Although the clamps of the present embodiments have been described for use with storage batteries and for coupling battery charging and testing equipment to storage batteries, the embodiments can be employed in any system where electrical connections and clamps are utilized. The different clamps employed in the above embodiments are only illustrative in nature and those skilled in the art will appreciate that the teachings of the present disclosure may be practiced with any clamp capable of electrically coupling to a contact.

What is claimed is:

1. A clamp comprising:

a post-grasping portion;

a male plug feature, mechanically coupled to the post-grasping portion and electrically isolated in the clamp, configured to fit into a female receptacle terminal;

a first electrically conductive piece; and a second electrically conductive piece, wherein the first electrically conductive piece and the second electrically conductive piece are mechanically coupled to, and electrically isolated from, the male plug feature, and wherein the first electrically conductive piece and the second electrically conductive piece are configured to electrically couple to the female receptacle terminal when the male plug feature is inserted into the female receptacle terminal.

2. The clamp of claim 1 and wherein each one of the first and second electrically conductive pieces is arc shaped.

3. The clamp of claim 1 wherein the first and second electrically conductive pieces are coupled to a Kelvin connection.

4. The clamp of claim 1 wherein the first and second electrically conductive pieces comprise copper.

5. The clamp of claim 1 wherein the post grasping portion comprises jaws.

6. The clamp of claim 1 wherein the male plug feature comprises a bolt.

7. The clamp of claim 6 wherein the bolt is a thumbscrew or a knurled bolt.

8. A battery tester including the clamp of claim 1.

9. A battery charger including the clamp of claim 1.

10. The clamp of claim 1 wherein the first electrically conductive piece is electrically isolated from the second electrically conductive piece.

11. The clamp of claim 10 and wherein the post-grasping portion comprises a first post-grasping member and a second post-grasping member.

12. The clamp of claim 11 and wherein the first electrically conductive piece and the first post-grasping member are coupled to a first Kelvin conductor, and wherein the second electrically conductive piece and the second post-grasping member are electrically coupled to a second Kelvin conductor.

13. A Kelvin clamp configured to attach to battery contacts that include a battery post and a female receptacle terminal, the Kelvin Clamp comprising:

a post-grasping portion configured to attach to the battery post;

a male plug feature, mechanically coupled to the post-grasping portion and electrically isolated in the clamp, configured to fit into the female receptacle terminal;

a first electrically conductive piece; and a second electrically conductive piece, wherein the first electrically conductive piece and the second electrically conductive piece are mechanically coupled to, and electrically isolated from, the male plug feature, and wherein the first electrically conductive piece and the second electrically conductive piece are configured to electrically couple to the female receptacle terminal when the male plug feature is inserted into the female receptacle terminal, and wherein the first electrically conductive piece is coupled to a first Kelvin conductor and the second electrically conductive piece is coupled to a second Kelvin conductor.

14. A battery tester including the clamp of claim 13.

15. A battery charger including the clamp of claim 13.

* * * * *